US012391451B2

(12) United States Patent
Bussey, III et al.

(10) Patent No.: US 12,391,451 B2
(45) Date of Patent: Aug. 19, 2025

(54) BLANK FOR MAKING AN ANGLE BOARD

(71) Applicant: International Cushioning Company, LLC, Marlboro, NJ (US)

(72) Inventors: Harry Buddy Bussey, III, Atlantic Highlands, NJ (US); Harry Brandon Bussey, IV, Tinton Fallls, NJ (US); Kyle Ryan Bussey, Atlantic Highlands, NJ (US)

(73) Assignee: INTERNATIONAL CUSHIONING COMPANY, LLC, Marlboro, NJ (US)

( * ) Notice: Subject to any disclaimer, the term of this patent is extended or adjusted under 35 U.S.C. 154(b) by 9 days.

(21) Appl. No.: 18/373,428

(22) Filed: Sep. 27, 2023

(65) Prior Publication Data

US 2024/0101331 A1 Mar. 28, 2024

Related U.S. Application Data

(60) Provisional application No. 63/410,833, filed on Sep. 28, 2022.

(51) Int. Cl.
*B65D 81/05* (2006.01)

(52) U.S. Cl.
CPC ..... *B65D 81/054* (2013.01)

(58) Field of Classification Search
CPC .. B65D 81/054; B65D 5/5033; B65D 81/056; B65D 2581/053; B65D 81/053
USPC ..... 206/586, 521
See application file for complete search history.

(56) References Cited

U.S. PATENT DOCUMENTS

| | | | | |
|---|---|---|---|---|
| 4,399,915 | A * | 8/1983 | Sorenson | B65D 5/5033 206/453 |
| 4,883,179 | A * | 11/1989 | Dionne | B65D 81/057 206/453 |
| 5,307,928 | A * | 5/1994 | Bishop | B65D 5/5033 206/320 |
| 5,511,667 | A * | 4/1996 | Carder | B65D 65/44 206/521 |
| 5,950,835 | A * | 9/1999 | Moser | B31F 1/0009 206/586 |
| 8,623,489 | B2 * | 1/2014 | Depaoli | B32B 3/28 229/87.01 |
| 2005/0121357 | A1 * | 6/2005 | Robinson, Jr. | B65D 81/054 206/586 |
| 2014/0069842 | A1 * | 3/2014 | D'Anglade | B31D 3/04 493/128 |

* cited by examiner

*Primary Examiner* — Steven A. Reynolds
(74) *Attorney, Agent, or Firm* — Francis C. Hand; CARELLA, BYRNE, ET AL

(57) ABSTRACT

A blank of flat corrugated board is formed with a longitudinal perforation or crease to enable folding into an angle board. A double coated tape strip is adhered on the flat body opposite the perforation or over the crease and a release layer is disposed over said tape strip. After removal of the release layer, the flat board may be folded into an angle board shape with the adhesive maintaining the folded sections of the flat body together.

10 Claims, 2 Drawing Sheets

BLANK FOR MAKING AN ANGLE BOARD

This application claims the benefit of Provisional Patent Application 63/410,833 filed Sep. 28, 2022.

This invention relates to a blank for making an angle board.

As is known, angle boards have been constructed for use as corner boards, for example, for use on palletized loads during the shipping and handling process and are placed at the corners of the palletized load. Typically, corner hoards are constructed from rigid materials to provide durable edge protection and add vertical support, helping to maintain load integrity and improve stacking strength. In some cases, the corner boards are used with stretch wrapping and strapping materials to supplement the stability of palletized loads.

In some cases, cornerboards have been made of laminated solid fibreboard made from 100% post consumer recyclable paper utilizing PVA glue to bond the laminations together.

The standard process of making laminated angle boards is known in the prior art and is practiced by various paper product companies. Laminated angle board is made by gluing multiple strips of paper together, folding the stiff layered-paper, or board, into a right angle along its length, and then cutting the angle board into a desired length. The width of the angle board is determined by the width of the strips of paper laminated together to form the board.

As described in US 2008/005360'7, rolls of paper are fed along various rollers into a cascading glue pot where glue is applied to one side of each layer of paper via the use of a hose, positioned above the top of each layer, The layers of paper then pass through an alignment device and are pressed together, or laminated, into one solid thicker piece. When manufacturing thinner pieces, glue application maybe removed from one or more internal layers resulting in two or more separate solid laminates being produced simultaneously.

However, corner boards made of paper can become relatively heavy. As is known, all paper angle board is very heavy and restricts the amount that can be shipped on a truck. For example, should the weight capacity of a truck be exceeded before the truck is filled, there is an empty space within the truck that is being shipped.

Further, the strapping materials that are used to secure the corner boards to a palletized stack can slide out of place during transport running the risk of a stack falling apart.

As described in U.S. Pat. No. 6,540,080, in order to provide for a resilient cushioning property to protective wraps to prevent damage upon impact from mechanical or manual handling at least one layer of a closed or open cell foam is laminated in between laminated layers of paper and formed to a rigid right angle, a C-channel, or any angled shape.

However, corner boards made of paper and foam layers are also relatively heavy.

Accordingly, it is an object of the invention to provide a blank of corrugated material that can be processed into a corner board of light weight construction.

It is another object of the invention to provide corner boards of light weight that enable a truck to be completely tilled to volume capacity without exceeding the weight limit of the truck.

Briefly, in one embodiment, the invention provides a blank for making an angle board comprising a flat body of corrugated board having a longitudinally disposed groove extending along the length thereof to define a hinge between adjacent longitudinal sections of the body, a double coated tape strip adhered over and along the groove and a release liner disposed over the tape strip.

Upon removal of the release liner from the tape strip to expose the adhesive of the tape strip, the flat body is bendable along the groove to adhere opposed sides of the groove together to define an angle board having the adjacent longitudinal sections disposed at an angle relative to each other.

The resultant angle board may then be applied to the corner of a palletized load or corner of a wall or other cornered surface utilizing the adhesive to adhere the angle board in place.

Of note, the tape strip being bent along with the adjacent longitudinal sections of the board adheres the opposed sides (or walls) of the groove together to maintain the angle defined by these sections.

The corrugated board includes at least three layers of flat paper and two layers of corrugated paper interposed between the layers of flat paper in alternating manner.

The double coated tape strip and release liner are purchased as a unit from Infinity Tapes, LLC of Lawrence, Massachusetts under the product name General Purpose Double Coated Permanent Tape with White BOPP Release Liner and product code HK6702.

Typically, the flat body has a width of 6 inches and a thickness of 0.200 inches and is of a length of 48 inches, in addition, flat body has a weight of 5.0 ounces without the tape strip and release layer.

By way of comparison, a conventional all paper corner board made with the same dimensions weighs 6.2 ounces.

However, the dimensions of the flat body may vary depending upon the end use of the angle boards. For example, the length may range from 24 inches (2 feet) to 144 inches (12 feet). Likewise, the width may vary from 1 inches to 12 inches.

In another embodiment, the blank for making an angle board is provided with a line of slits or perforations on the backside opposite the crease for ease of folding.

In still another embodiment, the blank is made without a crease on one side and a line of slits or perforations on the opposite side. In this embodiment, a double coated tape strip and release liner are used as above. Upon removal of the release liner, the blank may be folded about the line of silts (or perforations) to bring opposing adhesive surfaces on the folded sections of the blank into contact thereby maintaining the blank in the folded angle board shape. The remaining exposed adhesive coated surfaces may then facilitate adhesion to a cornered surface.

Various modifications may be made in the blank to accommodate the expected use of the angle board to be made. For example, where the blank is of corrugated material, the corrugations may run transversely of the board to be perpendicular to the bend in the angle board or may run longitudinally of the board to facilitate bending of the board into an angle board. The blanks may be bent into an angle board with two sections of equal width or unequal width, for example, one section may be 1 inch wide the othet section 3 inches wide.

Further, the release liner may be removed from the blank and the blank may be folded with the exposed adhesive on the outside. The thus folded board may then be applied to the inside corner of a box or the like to stiffen the corner.

Further, the thickness of the blank may range for 1/16 inch to 2 inches thick. In this respect, where the blank is grooved, the groove may be formed with an arcuate shape or one with flat side walls that are on an angle of 45°.

These and other objects and advantages of the invention will become more apparent from the following description taken in conjunction with the drawings wherein.

Figure 1:
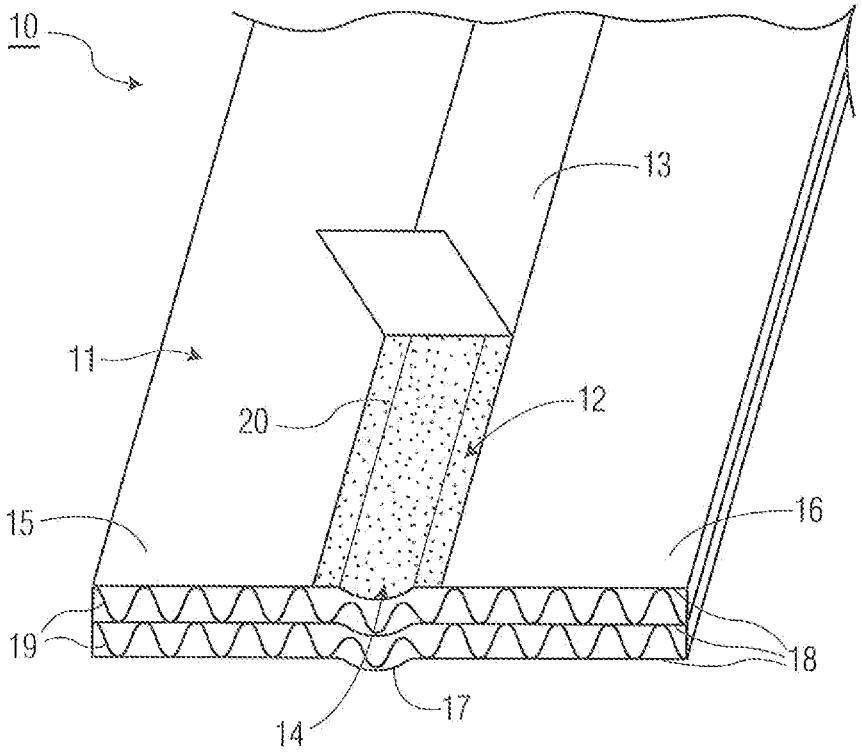
FIG. 1 illustrates a perspective vie of a blank for making an angle board constructed in accordance with the invention.

Referring to FIG. 1, the blank 10 is formed of a flat body 11 of corrugated board, a double coated tape strip 12 and a release liner 13.

The flat body 11 has a longitudinally disposed groove 14 extending along the length thereof to define a hinge between adjacent longitudinal sections 15, 16 of the body 11.

The groove 14 is formed as an indentation in the flat body 11 at the time of manufacture and has a depth that is about one-third the thickness of the flat body 11. As illustrated, formation of the groove 14 on one side of the flat body 11 creates a projecting ridge 17 on the opposite side of the flat body 11 while slightly crushing the flat body 11 therebetween.

The groove 14 may have any suitable cross-sectional shape so that the opposite sides (or walls) of the groove 14 may be brought together and abutted against each other upon bending of the longitudinal sections 15, 16 towards each other and about the groove 14.

The flat body 11 is formed of three layers of flat paper 18 and two layers of corrugated paper 9 interposed between the layers of flat paper 18 in alternating manner.

The double coated tape strip 12 has an adhesive on opposite surfaces and is adhered over and along the groove 14 while the release liner 13 is a silicone material that is disposed over the tape strip 12.

The tape strip 12 and release liner 13 are obtained as a unit from Infinity Tapes, LLC of Lawrence, Massachusetts under the product name General Purpose Double Coated Permanent Tape with While BOPP Release Liner and product code HK6702. The underside of the tape strip 12, as viewed, has an adhesive for adhering the tape strip 12 over the groove 14 and adjacent portions of the longitudinal sections 15, 16. The outer surface of the tape strip 12 has an adhesive layer 20 for holding the release liner 13 in place.

The release liner 13 is made of silicone or the like to be releasably secured to the adhesive 20 on the tape strip 12 and readily removable manually when in use.

Typically, the flat body 11 of the blank 10 is made of a width of 6 inches, a thickness of 0.200 inches and a length of 48 inches. In addition, flat body 11 has a weight of 5.0 ounces without the tape strip and release layer 13.

However, depending upon the use of the blank 10, the dimensions may vary. For example, For example, the length may range from 24 inches (2 feet) to 144 inches (12 feet). Likewise, the width may vary from 1.5 inches to 12 inches.

Figure 2:
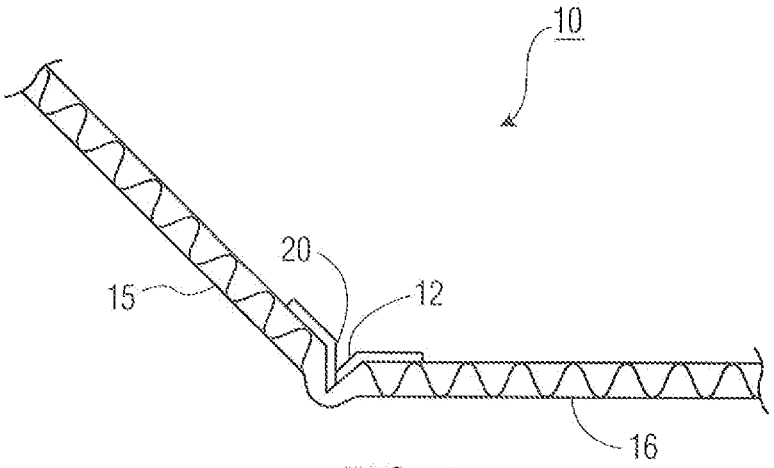
FIG. 2 illustrates a partial perspective view of the blank of FIG. 1 bent into an angled shape for use as a corner board.

Referring to FIG. 2, wherein like reference characters indicate like parts as above, in use, while the blank 10 is flat, the release liner 13 is removed, typically, manually, to expose the adhesive layer 20 on the tape strip 12. At this time, the flat body 11 can be bent along the groove 14 to have the opposite sides of the groove 14 brought together with the adjacent longitudinal sections 15, 16 disposed at an angle of 90° relative to each other for use as an angle board. At this time, the opposite sides of the groove 14 adhere to each other to maintain the longitudinal sections 15, 16 in the bent shape of an angle board.

Due to the blank 10 being made flat, a larger quantity of flat blanks 10 may be shipped in a truck load as compared to a shipment of angle boards.

The groove 14 acts as a hinge within the body 11 to allow the longitudinal sections 15, 16 to be bent relative to each other.

Once the blank 10 is deformed into an angled shape of an angle board, the angle board may be used in a conventional manner.

Since the tape strip 12 extends beyond both sides of the groove 14 onto the longitudinal sections 15, 16, the bent angle board shape of the blank 10 has an exposed layer of adhesive. Thus, the resultant angle board may he held in place on the corner of a palletized load by the adhesive layer 20 prior to a stretch wrapping and/or strapping step. In a similar manner, the resultant corner board may be adhered to a corner of a wall for protecting the corner against impact forces.

The blank 10 with the double coated tape strip 12 and release liner 13 when bent forms a corner board characterized in having a pair of longitudinal sections 15, 16 defining an angle therebetween and having longitudinally extending surfaces facing earth other; and a layer of adhesive 20 extending longitudinally between the longitudinal sections and adhering the longitudinally extending surfaces together to maintain the pair of longitudinal sections at an angle. Of note, the longitudinally extending surfaces of the longitudinal sections, 15, 16 correspond to the side wails of the groove 14.

The corner board is further characterized in having the layer of adhesive exposed on each of the longitudinal sections so as to have a self-contained adhesive for adhering to a cornered surface to be protected or aligned as is a palletized load.

The blank 10 may be formed in a relatively easy manner as compared to angle boards of all paper or angle boards of paper and foam.

For example, a web of corrugated board may be generated on conventional machinery and, while traveling, slit into a multiple of strips of the same width or different widths.

Once slit, the individual streams of corrugated strips may be grooved during continued travel and have the tape strip and release layer applied over the grooves. Thereafter, the corrugated strips may be severed into desired lengths to form the blanks 10.

Alternatively, a web of corrugated board may provided with multiple grooves corresponding to the locations of the multiple strips that are to he formed and also provided with the overlying tape strip/release liners. The resultant web may then be slit into individual strips and severed to length.

Figure 3:
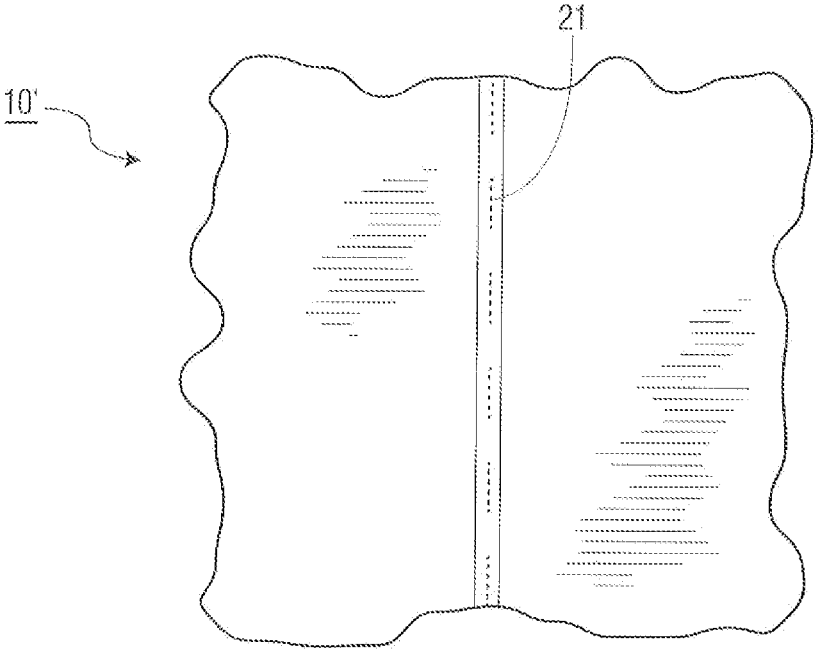
FIG. 3 illustrates the front of a board made with a line of perforations in a crease to ease bending into an angle board.

Referring to FIG. 3, in another embodiment, the board 10' is made with a line of perforations 21 in a crease to ease bending into an angle board 10'.

Figure 4:
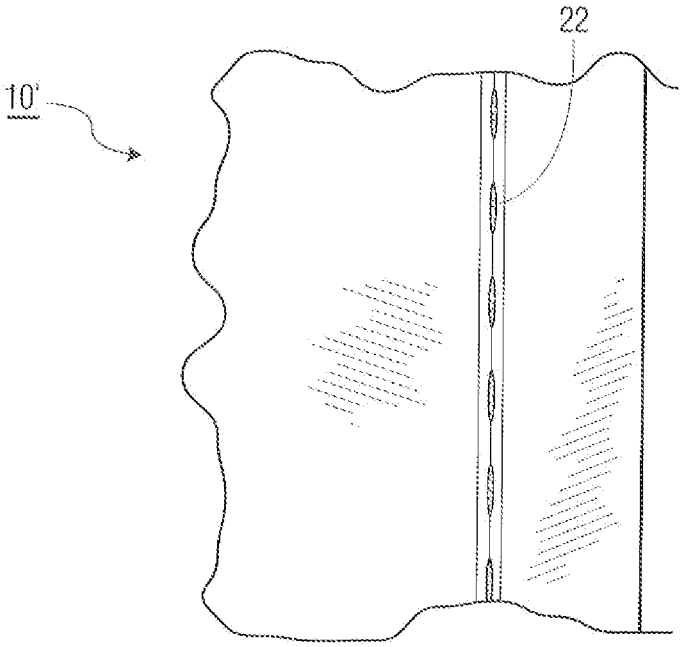
FIG. 4 illustrates the back of a board provide with a line of slits.

Referring to FIG. 4, in still another embodiment, the back of a board 10' is provided with a line of slits 22.

In another embodiment, the blank 10 may be scored to allow the tops of the two sections of the formed angle board to be folded inwardly to rest on the top of a palletized load.

In still another embodiment, the blank 10 may be scored transversely at spaced apart lengths to allow a user to separate a blank 10 into shorter pieces to accommodate usage on a cornered surface.

The invention thus provides a blank of corrugated material that can be processed into a corner board of light weight construction. Further, the invention provides flat blanks of light weight for making corner boards that can be readily shipped in bulk and that enable a truck to be completely filled to volume capacity without exceeding the weight limit of the truck.

The invention also provides a corner board with self-contained adhesive to apply directly to the corner of a palletized load or other cornered surface without the need for added strapping materials of the like.

What is claimed is:

1. A blank for making an angle board comprising a flat body of corrugated board having a longitudinally disposed groove extending along the length thereof to define a hinge between adjacent longitudinal sections of said body;

a tape strip with adhesive on opposite surfaces adhered over and along said groove and a portion of each of said adjacent longitudinal sections; and a release layer disposed over said tape strip whereby upon removal of said release layer from said tape strip, said body is bendable along said groove to adhere opposed sides of said groove together to define an angle board having said adjacent longitudinal sections disposed at an angle relative to each other and to have a self-contained adhesive on each of said adjacent longitudinal sections for adhering to a cornered surface.

2. A blank as set forth in claim 1 wherein said corrugated board includes at least three layers of flat paper and two layers of corrugated paper interposed between said layers of flat paper in alternating manner.

3. A blank as set forth in claim 1 wherein said tape strip is a double sided tape.

4. A blank as set forth in claim 1 wherein said flat body has a width of 6 inches and a thickness of 0.200 inches.

5. A blank as set forth in claim 4 wherein said flat body has a weight of 5.0 ounces and a length of 48 inches.

6. A blank as set forth in claim 4 wherein said flat body has a length in the range of from 24 to 144 inches.

7. A blank for making an angle board comprising a flat body of corrugated board;

a perforation extending longitudinally of said flat body to define a pair of longitudinal sections of said body;

a tape strip with adhesive on opposite surfaces adhered longitudinally on said flat body opposite said perforation; and a release layer disposed over said tape strip whereby upon removal of said release layer from said tape strip, said body is bendable along said perforation to adhere opposed sides of said longitudinal sections together to define an angle board having said adjacent longitudinal sections disposed at an angle relative to each other and to have a self-contained adhesive on each of said adjacent longitudinal sections for adhering to a cornered surface.

8. A corner board comprising a pair of longitudinal sides defining an angle therebetween and having longitudinally extending surfaces facing each other; and a layer of adhesive extending longitudinally between said longitudinal sides and adhering said longitudinally extending surfaces together to maintain said pair of longitudinal sides at said angle, said layer of adhesive extending onto each of said longitudinal sides and being exposed for adhering to a cornered surface.

9. A corner board as set forth in claim 8 further comprising a release layer over said layer of adhesive.

10. A corner board as set forth in claim 8 having a line of perforations extending longitudinally between said longitudinal sides.

* * * * *